US005791063A

United States Patent [19]

Kesler et al.

[11] Patent Number: 5,791,063

[45] Date of Patent: Aug. 11, 1998

[54] AUTOMATED TRACK LOCATION IDENTIFICATION USING MEASURED TRACK DATA

[75] Inventors: John K. Kesler, Silver Spring; Robert J. McCown, Seabrook, both of Md.; Thomas D. Gamble, Annandale; Brian E. Mee, Manassas, both of Va.

[73] Assignee: Ensco, Inc., Springfield, Va.

[21] Appl. No.: 603,224

[22] Filed: Feb. 20, 1996

[51] Int. Cl.[6] ..... G01D 21/00

[52] U.S. Cl. ..... 33/651; 33/1 Q

[58] Field of Search ..... 33/1 Q, 338, 287, 33/523, 523.1, 523.2, 651; 73/146

[56] References Cited

U.S. PATENT DOCUMENTS

| | | | |
|---|---|---|---|
| 3,505,742 | 4/1970 | Fiechter | 33/338 |
| 3,517,307 | 6/1970 | Wallen, Jr. et al. | 33/523.2 |
| 3,864,039 | 2/1975 | Wilmarth | 33/287 |
| 4,005,601 | 2/1977 | Botello | 33/523.2 |
| 4,367,681 | 1/1983 | Stewart et al. | 33/287 |
| 4,391,134 | 7/1983 | Theurer et al. | 33/523.2 |
| 4,417,466 | 11/1983 | Panetti | 33/523 |
| 5,036,594 | 8/1991 | Kesler et al. . | |
| 5,113,767 | 5/1992 | Theurer | 33/287 |

*Primary Examiner*—Diego F. F. Gutierrez
*Assistant Examiner*—Andrew Hirshfeld
*Attorney, Agent, or Firm*—Sixbey, Friedman, Leedom & Ferguson; Daniel W. Sixbey

[57] ABSTRACT

A method and apparatus is provided for accurately locating a train or a track repair vehicle along the track, or to locate accurately a track defect. When measuring track geometry, i.e. gage, cross level, warp, the measuring device moves foot by foot along the track and senses and stores a historical profile of various track geometry parameters. The historical profile is stored in a form usable in a processor in the geometry measuring equipment on a train or repair vehicle. The vehicle is run for a set distance to generate a real time profile which is correlated with the historical profile to get a match and a starting location. Then the vehicle proceeds foot by foot correlating the real time profile with the historical one so that an exact location on a specific track can be determined.

23 Claims, 3 Drawing Sheets

AUTOMATED TRACK LOCATION IDENTIFICATION USING MEASURED TRACK DATA

TECHNICAL FIELD

The present invention relates to railroad track measuring methods generally and more particularly to a method and apparatus for track position location using measured track data.

BACKGROUND OF THE ART

In recent years, significant advances have been made in the design of track measuring and gauging equipment for determining the condition of railroad tracks. Accurate optical gauging units employing laser technology have been developed which can be mounted upon a railroad car and propelled along the track to be inspected. These systems operate to accurately sense track defects, variations in track profile and other track irregularities which might result in a dangerous condition.

Systems have been developed to take track geometry measurements along the rails of a track to detect relative level or other differences which might result in undesirable vehicle-track interaction. For example, U.S. Pat. No. 5,036,594 to Kesler et al. discloses a crosslevel measuring adapter which obtains and displays a crosslevel value while calculating a warp value and a crosslevel index value from successive crosslevel values.

Prior track measuring systems have proven effective for sensing and recording track defects and potentially dangerous track conditions, but once such conditions have been recorded, it is often difficult to accurately relocate the position along the track where the condition exists. Track repair vehicles are often forced to estimate the distance to a recorded track defect from a known point and to then physically search the track in the general area of the defect until the defect is located. This is both tedious and time consuming.

It is usually important to be able to accurately locate a moving train relative to a bad area of track which will require the train to be slowed to prevent undesired vehicle-track interaction. At present, since the exact location of the train may not be known, it is necessary to slow the train well before the bad area is reached, thereby causing an unnecessary delay and loss of time.

Accurate train location information is also critical for effective train control. At present, in track switching areas where a train travelling in a given direction is switched to a second track to permit the passage of a train travelling in the opposite direction, transponders in the track are used to identify the track over which the train is passing and to provide a positive indication that the train has been switched back to the original track. However, not only are transponders expensive, but they are also subject to vandalism and must be carefully maintained.

DISCLOSURE OF THE INVENTION

It is a primary object of the present invention to provide a novel and improved method and apparatus for locating a vehicle along a length of railroad track.

Another object of the present invention is to provide a novel and improved method and apparatus for locating a vehicle along a length of railroad track which includes measuring track geometry to obtain a profile of geometry parameters along a length of track and storing this profile as a historical profile. The historical profile is provided to a vehicle to be moved along the same length of track, and this vehicle measures track geometry to create a real time profile which is compared with the historical profile to locate the vehicle.

Yet another object of the present invention is to provide a novel and improved method for locating a vehicle along a railroad track which employs at least two different types of track geometry measurements in a historical and a real time profile. The historical profile is prerecorded from the length of track and the real time profile is created during movement of a vehicle along the track and is compared to the historical profile.

A still further object of the present invention is to provide a novel and improved method for locating a vehicle along a railroad track which employs crosslevel and gage measurements taken along the length of track to provide data for a historical and a real time profile. The historical profile is prerecorded from the length of track, and the real time profile is created as the vehicle moves along the track for comparison with the historical profile.

Still another object of the present invention is to provide a novel and improved method and apparatus for obtaining and comparing track data from two sequential inspection surveys taken over the same track for the purpose of a real time comparative analysis which will disclose track changes over time that may be indicative of structural failure.

A still further object of the present invention is to provide a novel and improved method and apparatus for obtaining and comparing track data to aid maintenance personnel to identify the precise location of measured track conditions while synchronously displaying data from a previous survey during a later run and marking the location of track areas of interest.

These and other objects of the invention are accomplished by measuring and recording one or more track geometry characteristics having a recognizable signature along a length of track as well as track distance data to create a historical profile. The historical profile for an entire length of track or for selected areas, such as five hundred feet on either side of each switch in an entire length of track, can be effectively stored, such as by CD ROM, for subsequent use in a personal computer and display system. During a subsequent run along the same length of track, a comparison analysis is made between real time track geometry data and that from the stored historical profile. This is accomplished by defining a position window as a database reference along the track through the use of the global positioning system (GPS) or some other position indicating mechanism, and then providing a block, such as four thousand and ninety six feet, of historical track profile data encompassing the position window and an area on either side thereof. A smaller block of real time track geometry data, such as data for five hundred feet of track, is then correlated with the block of historical data until a match is identified. Once a match is obtained, small blocks of real time data are matched with historical profile data as the train or survey car progresses down the track. A synchronous display of historical profile data shows previously surveyed track defect areas before they are reached, and these areas can be marked for maintenance as the survey car passes over them.

BEST MODE FOR CARRYING OUT THE INVENTION

To accomplish the method of the present invention, an initial survey is taken along a length of track with electronic or optical sensing equipment to measure track geometry and provide data indicative of geometry parameters along the length of track. Track defects are identified and included in this track geometry data which is recorded as a historical profile and stored. This stored historical profile is then provided to a vehicle to be subsequently moved along the same length of track, and this vehicle is provided with similar electronic or optical sensing equipment to measure track geometry. As this vehicle moves along an initial section of track, track geometry is again measured to obtain data for a new or real time profile of track geometry parameters, and this new profile is compared to the historical profile to identify a match between the two. Using this match as a starting point, measurement data is continuously obtained as the vehicle moves on, and the data from this new profile is continuously correlated to that in the historical profile to obtain a correlation point which advances as the vehicle advances down the track. The location of the vehicle relative to a track defect can be accurately determined by comparing the relationship of the correlation point to a track defect location recorded on the historical profile.

The accuracy of the vehicle location method is enhanced by providing more than one type of track geometry data for comparison in the historical and real time profiles. Any type of track geometry measurement which will result in a recognizable signature can be used. High speed track geometry survey vehicles are conventionally used to detect a multiplicity of track characteristics having a clearly recognizable signature. For example, gage, which is the distance between the rails measured five eighths of an inch below the rail top surface can be detected as well as crosslevel, which is the amount of elevation of one rail above the other. Clear track geometry signatures can also be obtained by measuring profile, which is the surface uniformity of each rail measured at the mid-point of a sixty two foot chord and alignment, which is the line uniformity of each rail measured at the mid-point of a sixty two foot chord. Even warp, which is the deviation of crosslevel over sixty two feet of nonspiral track and thirty one feet of spiral track or curvature, which is a measure of the angular change in track direction per one hundred foot track chord may be used.

Figure 1:
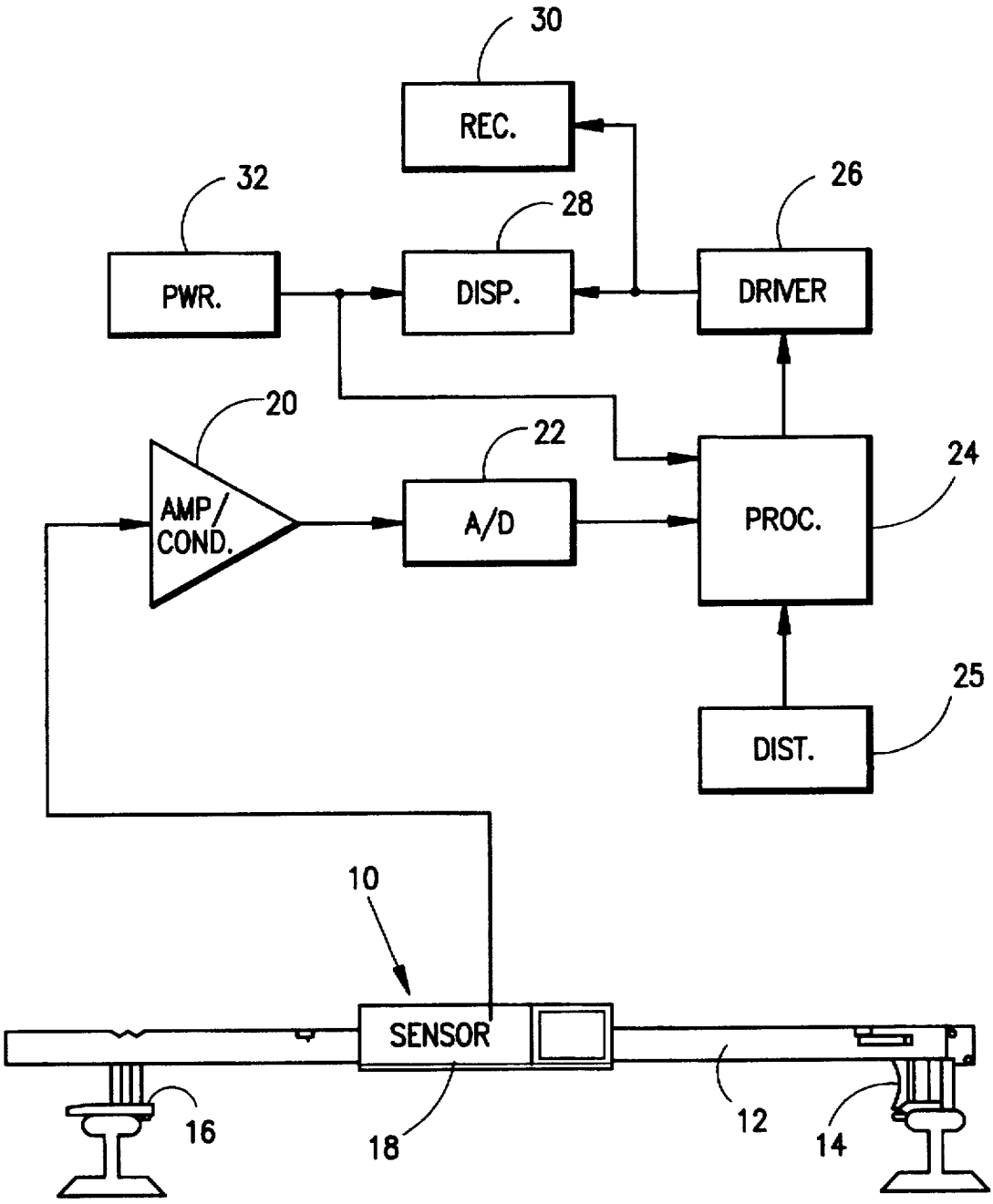
FIG. 1 is a block diagram of a crosslevel measuring system used in the method of the present invention.

A number of known track geometry measurement sensors can be used to obtain track geometry data. For purposes of example in FIG. 1, crosslevel and warp data of the type obtained by the method and apparatus disclosed in U.S. Pat. No. 5,036,594 may be effectively employed in the vehicle location method of the present invention. This crosslevel and warp data is obtained using a crosslevel measuring adapter 10 mounted on an inclination measuring bar 12 carried by a track mounted vehicle. The inclination measuring bar has track engaging plate assemblies 14 and 16 at opposite ends thereof, and the crosslevel measuring adapter includes a level sensing transducer assembly 18 which provides an analog signal having an amplitude indicative of a crosslevel value to an amplifier and signal conditioning circuit 20. The level sensing transducer may be one of several known level sensing units which include a pendulum or similar device to sense level changes and to provide an electrical output indicative thereof. In place of the bar 12, a sensor assembly 18 may be mounted directly on the axle of a survey car, and could constitute a rate gyro to provide mean removed crosslevel data.

The amplified output signal from the amplifier and signal conditioning circuit is provided to an analog-to-digital converter 22 which in turn furnishes a digital signal which is a function of the analog signal value to a processor 24. The processor performs calculations for warp values as previously described in U.S. Pat. No. 5,036,594 which is incorporated herein by reference and includes memory components for the storage of these and the crosslevel measurement values obtained by the crosslevel measuring adapter. Also the processor receives travel distance information from a track position sensor 25.

To initiate the measurements for the historic and real time profiles, the inclination measuring bar 12 is mounted on a vehicle for movement which will permit the bar to shift with track inclination, and the track engaging plate assemblies 14 and 16 are lowered into engagement with the spaced rails for the track. As the vehicle moves forward, periodic track inclination measurements are sequentially taken, normally at each track joint as the device is moved along the track. Each of these measurements constitutes a crosslevel value, and they may be automatically timed by the processor in accordance with vehicle distance measurements to occur in the vicinity of track joints in instances where track joints are evenly spaced along the track. Also sensing units to sense the occurrence of a track joint may be used to cause the processor to receive a crosslevel measurement.

After a specific number (X) of measurements are taken, a warp value is computed. Warp is the maximum difference between X number of crosslevel measurements, and generally warp would be the maximum difference between the last four crosslevel measurement values. Warp is compared to an allowable threshold value R1, and if warp is greater than this threshold value, an indication is given.

The crosslevel and warp values derived from the sequential measurements taken along a length of track are provided by the processor 24 to a driver 26 and a display unit 28 which provides a visual representation of these values. The driver also provides the crosslevel and warp values to a recorder 30 which provides a sequential record of these values as a profile indicative of the geometry along the length of track. This profile is preferably recorded on an electronic storage medium, such as a CD ROM, which can be used to input the profile, in the case of a historical profile, into the processor 24 for comparison with a real time profile in the display unit 28. Power for the system is provided by a power supply 32.

Once the historical profile has been recorded, the recorded data is provided to a vehicle which is to travel the length of track from which the historical profile has been obtained. This vehicle also is provided with a crosslevel measuring unit, which takes and records crosslevel measurements and computes warp values as the vehicle traverses an initial length of track. This data is recorded and compared with the recorded historical profile data until a match is identified. From the location where the match occurs, the real time profile taken by the moving vehicle is continuously compared to the historical profile to locate the vehicle relative to track defect data points indicated on the historical profile. This system facilitates the accurate location of a vehicle relative to track defects previously found during the measurements taken for the historical profile.

When a plurality of different measurement values, such as crosslevel, alignment, warp, gage, profile and curvature are obtained in both the historical and real time profiles, each such value in the real time profile is compared and correlated with the same value in the historical profile to enhance the accuracy of the vehicle location system.

Figure 2:
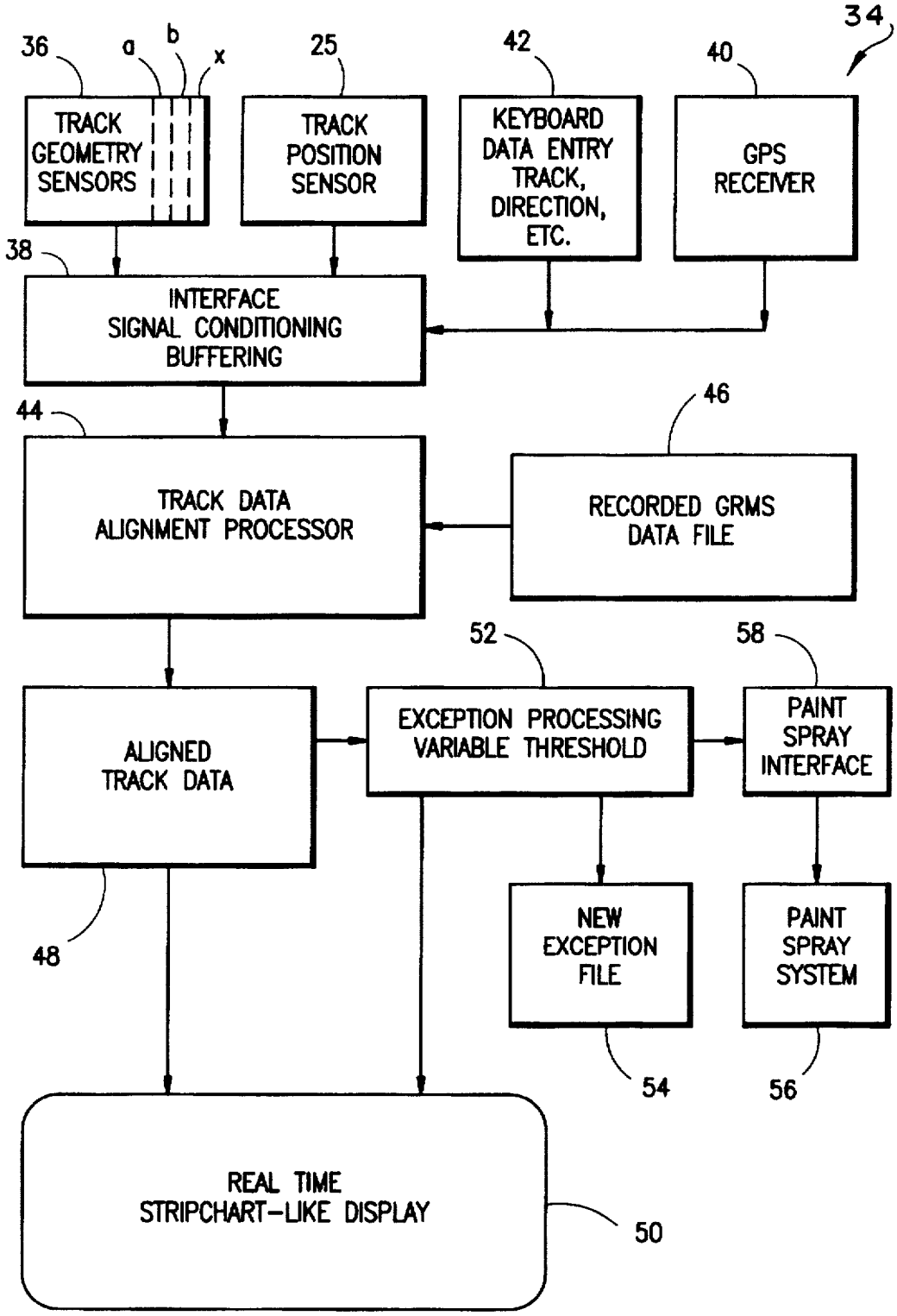
FIG. 2 is a block diagram of an automated track data alignment system of the present invention.

Referring now to FIG. 2, a more detailed diagram of the automated track data alignment system of the present invention is indicated generally at 34. Preferably, a plurality of different track geometry sensors 36 *a*, *b* and *x*, provide diverse track geometry measurement values, for example gage, crosslevel, profile and alignment to an interface, signal conditioning and buffering section 38. The section 38 includes a separate channel for data from each of the track geometry sensors where analog data is converted to digital form and stored. Also a channel is provided for distance data received from the track position sensor 25.

The interface, signal conditioning and buffering section 38 also receives general location data from a global positioning receiver 40 and manually entered data from a keyboard data entry system 42. A track data alignment processor section 44 correlates data from the section 38 with recorded historical data from a recorded data file 46 in a manner to be described. When the interface, signal conditioning and buffering section 38 includes multiple channels, the processor 44 sequentially correlates data from each channel with data from a corresponding channel in the recorded data file 46 to obtain track data alignment for each channel.

The track data alignment processor 44 acquires data from the interface, signal conditioning and buffering section 38, accesses data from the recorded data file 46, correlates the data and transfers data to a second aligned track data section 48 for display. The second section 48 controls a data display 50 and receives the operator input from the keyboard data entry section 42. The operator input may include the track number, the starting milepost, the direction of travel and the channel number containing data to be correlated.

Data from the aligned track data section 48 is compared with a preset variable threshold in an exception processing section 52 to identify track faults which exceed the threshold. These faults and their location is recorded in a file 54. If the survey vehicle is provided with a paint spray system 56, a signal is sent from the exception processing section 52 to a paint spray interface 58 when a fault is identified to activate the paint spray system 56. Paint spray positions can be precomputed based upon historical stored data, can be initiated in response to real time data, or can be initiated upon a correlation of historical and real time fault data. Normally, a fault location would be identified during a previous track survey, and correlation between the real time and historical track data would accurately locate the vehicle so that the fault area would be sprayed with paint. Actually, the exception processing section 52 may include various graduated thresholds so that the severity of a fault can be determined based upon the level of threshold exceeded. The fault severity level would be recorded in the new exception file 54, and may control the paint spray interface 58 so that paints of different colors indicative of fault severity are sprayed by the paint spray system 56. Fault severity identification provides an indication of which faults require immediate maintenance and simplify maintenance scheduling.

Figure 3:
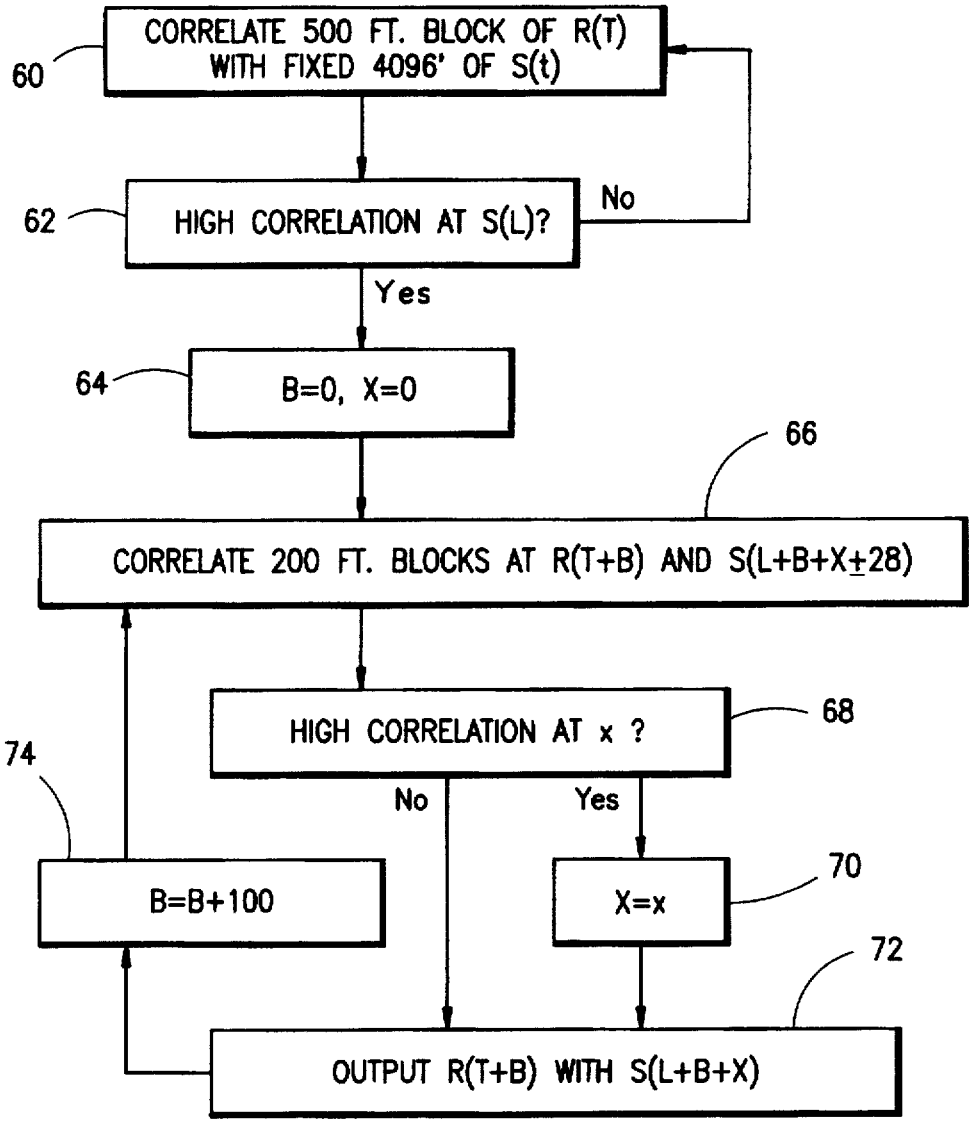
FIG. 3 is a flow diagram illustrating the operation of the system of FIG. 2.

FIG. 3 is a flow diagram illustrating the operation of the track data alignment processor 44. To initiate a correlation search at 60, the general location data from the global positioning receiver 40 which is indicative of the general area along the track where the vehicle is located is used as a database reference to select an initial block of stored historical data S(t) from the recorded data file 46. The size of this block, for example, four thousand ninety six feet, is preset by the keyboard data entry 42, and includes historical data derived from the track area indicated by the global positioning receiver as well as data from a length of track on either side of this area. A smaller block of real time data R(t) from a track geometry sensor 36 is then compared foot by foot with the block of historical data in search of a match to determine if correlation exists at 62. If a match is not found, a new small block of real time data is compared with the large block of historical data until a correlation occurs. At this starting or alignment point 64, accumulated lag (B) and distance travelled (x) will be equal to zero. Accumulated lag is the sum of lag L which is error in distance measurement caused by such factors as slip, track curvature, etc.

Starting at alignment point 64, small increments of real time data; i.e. 200 foot blocks, plus accumulated lag B are compared with the stored historical data including lag L, accumulated lag B and distance X plus or minus a 28 foot window to allow for distance variations caused by track changes occurring in the time period between the real time and historical data. If correlation at 66 is found to occur at 68, then a new alignment point is established at 70 with distance equal to the actual distance travelled and the next 200 foot block is correlated at 72. On the other hand, if correlation does not occur at 68, then at 72 an indication is given to move the block of historical data 100 feet at 74 and to initiate a new attempt at correlation at 66.

Figure 4:
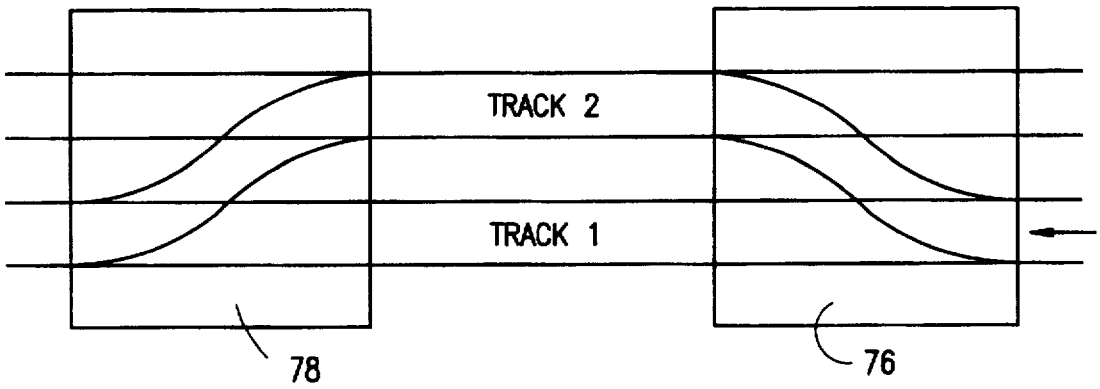
FIG. 4 is a diagram of a track switching system illustrating train control using the present invention.

Referring now to FIG. 4, the method of the present invention can be effectively employed in train control situations to replace the track sensors previously used. For example, in track switching situations, a train approaching a switching area 76 on track 1 may need to be diverted to track 2 by switches in area 76 to permit a second train to pass through in the opposite direction on track 1. When the first train reaches a second switching area 78, it is again to be routed back onto track 1, and each time this switching operation occurs, it is important for a train crew to be able to ascertain that they have been switched to the proper track when they leave the respective switching areas. In accordance with the present invention, this can be accomplished by recording a separate historical profile of tracks 1 and 2 for a distance on either side of each switching area 76 and 78. Once a train passes through a switching area, a real time profile is begun and the data is compared with the historical data profile for the desired track to confirm that a proper switching operation has taken place. If a match is not obtained, the real time data is compared with the historical data from the undesired track to determine if a switching error has occurred. It is possible to store historical profile data for every switching area along a route on a CD ROM so that a train crew can confirm the accuracy of each switching operation.

For centralized train control, it is obvious that real time profile data can be transmitted to a computer in a central control center for comparison with a prerecorded historical profile. However, the present invention is most effectively used on board a moving railroad vehicle, for by displaying historical profile data for an area of track on both sides of the vehicle in combination with the vehicle location determined by the correlation of real time and historical profile data, it is possible to view the track area both behind and in front of the moving vehicle. Thus track defects and other track signature locations can be identified as the vehicle approaches and after the vehicle passes by them.

We claim:

1. A method for accurately locating a vehicle along a track during movement of the vehicle along the track which includes:

first developing a historical profile of the track by measuring the geometry of the track to obtain a profile of track geometry parameters along a length of track;

storing the historical profile of track geometry parameters;

subsequently providing the historical profile to the vehicle to be moved along said length of track;

moving the vehicle along said length of track and developing a real time profile of the track by measuring the geometry of the track to obtain a real time profile of track geometry parameters as the vehicle moves along the length of track; and comparing the real time profile with the historical profile as the vehicle moves along the length of track to identify a match therebetween to indicate vehicle location.

2. The method of claim 1 wherein the comparison of the real time and historical profiles includes continuing to compare the real time profile to the historical profile as the vehicle moves along the length of track from the starting position.

3. The method of claim 2 wherein said historical profile of track geometry parameters includes a geometry parameter indicative of a track defect said method further including obtaining the match as a starting position between said real time and historical profiles prior to the vehicle reaching the area of said track defect during the development of the real time profile.

4. The method of claim 3 wherein the comparison of the real time and historical profiles includes comparing the real time profile to the historical profile subsequent to obtaining the match as a starting point to provide an indication of a correlation point along the historical profile to which correlation with the real time profile has occurred, and using the correlation point to determine the relationship of the vehicle to the stored parameter indicative of the track defect.

5. The method of claim 4 wherein both said historical and real time profiles are developed by measuring track geometry by measuring the inclination between adjacent points on the surfaces of two rails of the track as a crosslevel measurement and taking a plurality of successive crosslevel measurements across said track at spaced points along the length of track to be measured.

6. The method of claim 4 which includes displaying at least a portion of the historical profile with the correlation point to display sections of said length of track both before and after said correlation point.

7. The method of claim 2 wherein the geometry parameters for both said historical and real time profiles are developed by obtaining at least a plurality of first track geometry parameter values and a plurality of second track geometry parameter values which differ from said first track geometry parameter values for said historical and real time profiles and wherein the comparison of the real time and historical profiles includes comparing the first track geometry parameter values in said real time profile with the first track geometry parameter values in the historical profile and comparing the second track geometry parameter values in said real time profile with the second track geometry parameter values in said historical profile.

8. The method of claim 7 where said first track geometry parameter values are crosslevel values and said second track geometry parameter values are gage values.

9. A method for locating a vehicle along a railroad track during movement of the vehicle along a length of the railroad track which includes:

first developing historical track data by sensing at least one type of track characteristic having an identifiable signature along the length of track to obtain a historical first set of track data for the length of track, concurrently sensing distance data along the length of track with said historical first set of track data, storing said historical first set of track data and said distance data as said historical track data, providing the historical track data to the vehicle to be moved along said length of track, moving said vehicle along the length of track and developing a real time set of track data by sensing the same type of track characteristic used to obtain said historical first set of track data, comparing the real time set of track data to the historical first set of track data during movement of the vehicle along the length of track to identify a data match between the real time track data and historical first set of track data, using the data match as a starting position, for the vehicle sensing real time distance data from the starting position and real time track data as the vehicle moves along the length of track, and continuing to continuously compare the real time data with the historical track data to obtain a continuing match between the two to indicate vehicle location.

10. The method of claim 9 which includes selecting a first block of said historical first set of track data derived from a first section of said length of track, and subsequently correlating a first block of real time data derived from a second section of said length of track with said first block of historical track data to search for said data match, said second section of said length of track being shorter than said first section.

11. The method of claim 10 which includes determining a position area along said length of track where said moving vehicle is located, and wherein the selecting of said first block of said historical set of track data incorporates track data derived from said first section of said length of track which includes and extends beyond said position area.

12. The method of claim 11 which includes providing said real time data from said second section of track which constitutes a portion of said first section of track.

13. The method of claim 9 wherein said at least one type of track characteristic is a plurality of different types of track characteristics along the length of track to obtain a set of track data for each type of sensed track characteristic and storing each set of sensed track data as said historical data, subsequently sensing each said type of track characteristic to obtain said real time set of track data therefor, and separately comparing each set of real time track data for each track characteristic with said set of historical data for the same track characteristic.

14. A method for accurately locating a railroad vehicle subsequent to passage by the vehicle over a railroad switch capable of switching the vehicle between a first length of track and a second length of track spaced from said first length of track which both extend on opposite sides of said switch which includes sensing at least one type of track characteristic having an identifiable signature along said first length of track for a first distance on opposite sides of said switch to obtain a first set of track data for said first length of track, sensing at least one type of track characteristic having an identifiable signature along said second length of track for a second distance on opposite sides of said switch to obtain a second set of track data for said second length of track, storing said first and second sets of track data as historical first and second sets of track data, providing the historical sets of track data to the vehicle to be moved over said switch, moving said vehicle over the switch and sensing the same type of track characteristics along a length of track after the switch which were used to obtain said first and second sets of historical track data to obtain a real time set of track data, and during movement of the vehicle along the length of track after the switch, comparing the real time set of track data to one of said first and second sets of historical track data to find a first data match therebetween to indicate vehicle location.

15. A method for accurately locating a railroad vehicle subsequent to passage by the vehicle over a railroad switch capable of switching the vehicle between a first length of track and a second length of track spaced from said first length of track which both extend on opposite sides of said switch which includes:

sensing at least one type of track characteristic having an identifiable signature along said first length of track for a first distance on opposite sides of said switch to obtain a first set of track data for said first length of track, sensing at least one type of track characteristic having an identifiable signature along said second length of track for a second distance on opposite sides of said switch to obtain a second set of track data for said second length of track, storing said first and second sets of track data as historical first and second sets of track data, providing the historical sets of track data to the vehicle to be moved over said switch, moving said vehicle over the switch and sensing the same type of track characteristics along a length of track after the switch which were used to obtain said first and second sets of historical track data to obtain a real time set of track data, during movement of the vehicle along the length of track after the switch, comparing the real time set of track data to one of said first and second sets of historical track data in an attempt to find a first data match therebetween indicative of vehicle location, and operating in the absence of the first data match to compare the real time set of track data to the remaining set of historical track data to find a second data match to indicate vehicle location.

16. An apparatus for locating a vehicle moving along a length of railroad track comprising central processor means for storing historical track data for said length of track derived from at least one type of track characteristic having an identifiable signature previously sensed along said length of track, track sensing means mounted upon said vehicle for sensing the track characteristic previously sensed to provide said historical track data, said track sensing means operating to sense said track characteristic as said vehicle moves along said length of track and to provide real time data which is a function of said sensed track characteristic to said central processor means, said central processor means including means for comparing upon receipt of said real time data, said real time data to said historical track data to identify a match between the two, said central processor means also including means for subsequently using the match as a starting position for the vehicle and continuing from the starting position to compare and match the real time data with the historical track data to locate the vehicle along the length of track.

17. The apparatus of claim 16 which includes visual display means connected to said central processor means, said central processor means configured to, subsequent to obtaining the match as a starting position, match the real time data with the historical track data as the vehicle moves along the length of track to obtain a correlation position after the starting point between the real time and historical track data and to provide historical track data for a section of track on either side of said correlation position and to provide correlation position data to said visual display means, said visual display means for providing a display upon receipt of said correlation position data and historical track data.

18. The apparatus of claim 17 which includes a distance sensor means mounted on said vehicle and connected to said central processor means, said distance sensor means for providing distance data indicative of the distance the vehicle has moved along the length of track to said central processor means.

19. A method for locating a vehicle along a railroad track during movement of the vehicle along a length of railroad track which includes:

first developing historical track data by sensing at least one type of track characteristic having an identifiable signature along the length of track to obtain a historical first set of track data for the track, concurrently sensing distance data along the length of track with said historical first set of track data, storing said historical first set of track data and said distance data as said historical track data, providing the historical track data to the vehicle to be moved along said length of track, moving said vehicle along the length of track and developing a real time set of track data by sensing the same type of track characteristic used to obtain said historical first set of track data, comparing the real time set of track data to the historical first set of track data during movement of the vehicle along the length of track to identify a data match between the real time track data and the historical first set of track data indicative of a staring position for the vehicle, said comparison between the real time set of track data and the historical first set of track data including selecting a first block of said historical first set of track data derived from a first section of said length of track and subsequently correlating a first block of real time data derived from a second section of said length of track which is within and shorter than said first section of said length of track with said first block of historical data to search for said data match, selecting a second block of real time data from a third section of said length of track which is within and shorter than said first section of said length of track if a data match between said first block of said historical first set of track data and said first block of real time data is not found and correlating said second block of real time data with said first block of said historical first set of track data to search for said data match, using an identified data match as a starting position for the vehicle, and sensing real time distance data from the starting position and real time track data as the vehicle moves from the starting position along the length of track and continuously comparing the real time data with the historical track data to obtain a continuing match between the two to indicate vehicle location.

20. The method of claim 19 which includes determining a position area along said length of track where said moving vehicle is located and selecting said first block of said historical set of track data to incorporate track data derived from said first section of said length of track which includes and extends beyond said position area, said real time data being provided from said second and third sections of track which constitute a portion of said first section of track.

21. An apparatus for locating a vehicle moving along a length of track comprising:

track sensing means mounted upon said vehicle for sensing at least one track characteristic as said vehicle moves along said length of track to provide real time data which is a function of said sensed track characteristic, distance sensing means mounted upon said vehicle for providing distance data indicative of the distance the vehicle has moved along the length of track, position means for providing a position signal defining a position window along the track within which said vehicle is located, and processor means for receiving said real time data, distance data and position signal and storing previously sensed historical track data for said length of track which is derived from said at least one track characteristic, said processor means for selecting a first block of historical track data for track extending across said position window and a second smaller block of real time data for a section of track within said position window and for comparing said second block to said first block to identify a data match indicative of the position of said vehicle along said length of track, the processor selecting selecting a third smaller block of real time data for a section of track extending from the data match position of the vehicle when a data match is identified and comparing said third block to said first block to identify a subsequent data match indicative of the position of said vehicle.

22. The apparatus of claim 21 wherein said track sensing means includes a plurality of different track geometry sensors to provide a plurality of diverse track geometry measurement values as the real time data, said previously stored historical track data including diverse track geometry measurement values derived from a plurality of different track geometry sensors which are the same as those used to provide the real time data, said processor means comparing each of the diverse track geometry measurement values in the real time data with the same type of track geometry measurement in the historical track data.

23. The apparatus of claim 22 wherein said position means includes a global positioning receiver.

* * * * *